United States Patent [19]

Ma

[11] Patent Number: 5,002,080

[45] Date of Patent: Mar. 26, 1991

[54] FOLDABLE TWIN UMBRELLA APPARATUS

[76] Inventor: Mark Ma, 1415 Martins Dr., Hammond, La. 70401

[21] Appl. No.: 494,433

[22] Filed: Mar. 16, 1990

[51] Int. Cl.[5] ..... A45B 11/00

[52] U.S. Cl. ..... 135/20 A; 135/33 R; 135/76

[58] Field of Search ..... 135/20 A, 33 R, 76, 135/37, 28, 20 R; 52/DIG. 13

[56] References Cited

U.S. PATENT DOCUMENTS

| | | | |
|---|---|---|---|
| 779,241 | 1/1905 | Schuller | 135/20 A |
| 2,945,234 | 7/1960 | Driscoll | 135/28 X |
| 4,094,021 | 6/1978 | Rapp | 52/DIG. 13 X |
| 4,274,429 | 6/1981 | Kinski | 135/20 A |
| 4,465,288 | 8/1984 | Kofoed, Sr. | 52/DIG. 13 X |
| 4,479,504 | 10/1984 | Harng | 135/20 A |
| 4,714,136 | 12/1987 | Morin | 52/DIG. 13 X |

FOREIGN PATENT DOCUMENTS

| | | | |
|---|---|---|---|
| 155651 | 11/1904 | Fed. Rep. of Germany | 135/20 A |
| 573932 | 4/1933 | Fed. Rep. of Germany | 135/20 A |
| 335396 | 9/1903 | France | 135/20 A |
| 521616 | 3/1955 | Italy | 135/20 A |
| 653803 | 3/1963 | Italy | 135/20 A |

*Primary Examiner*—David A. Scherbel
*Assistant Examiner*—Lan Mai
*Attorney, Agent, or Firm*—Pravel, Gambrell, Hewitt, Kimball & Krieger

[57] ABSTRACT

An umbrella having an umbrella cover portion, with a stem portion extending downward for providing the coverage for a single individual as a normal umbrella. Further, there is provided a means for separating the stem portion into two separate stem portions, with a section intermediate the stem portion expandable outward to provide that the single coverage umbrella portion expand to a double coverage umbrella portion, with the stem portions at their lowermost end, either hand held by one of the individuals, or may be separated to be held by both individuals being covered under the expanded fold of the umbrella.

5 Claims, 3 Drawing Sheets

FOLDABLE TWIN UMBRELLA APPARATUS

BACKGROUND OF THE INVENTION

1. Field of the Invention

The apparatus of the present invention relates to umbrellas. More particularly, the present invention relates to an umbrella which may expand from a single umbrella to a multiple umbrella having several handles for use by more than one individual.

2. General Background

In the art of umbrellas, it is often required that more than one person utilize an umbrella. However, the most common type of umbrella is utilized for a single individual, and therefore cannot really adapt to be used by multiple individuals. Therefore, is a need in the art for an umbrella which may be utilized as a single umbrella when it is utilized by an individual. However, it would be beneficial to have an umbrella that may be expanded from a single umbrella to a multiple umbrella so that the coverage underneath the umbrella is sufficient to allow several people to utilize the umbrella after it has been modified to its expanded configuration.

SUMMARY OF THE PRESENT INVENTION

The umbrella of the present invention solves the problems in the art in a simple and straightforward manner. What is disclosed is an umbrella having an umbrella cover portion, with a stem portion extending downward for providing the coverage for a single individual as a normal umbrella. Further, there is provided a means for separating the stem portion into two separate stem portions, with a section intermediate the stem portion expandable outward to provide that the single coverage umbrella portion expand to a double coverage umbrella portion, with the stem portions at their lowermost end, either hand held by one of the individuals, or may be separated to be held by both individuals being covered under the expanded fold of the umbrella.

Therefore, it is a principal object of the present invention to provide an umbrella that may go from its single coverage umbrella to a multiple coverage umbrella, for use by more than one individual.

It is still a further object of the present invention to provide a multiple umbrella that when not being utilized by more than one individual may be returned to the single individual configuration, and hand-held by a single individual.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
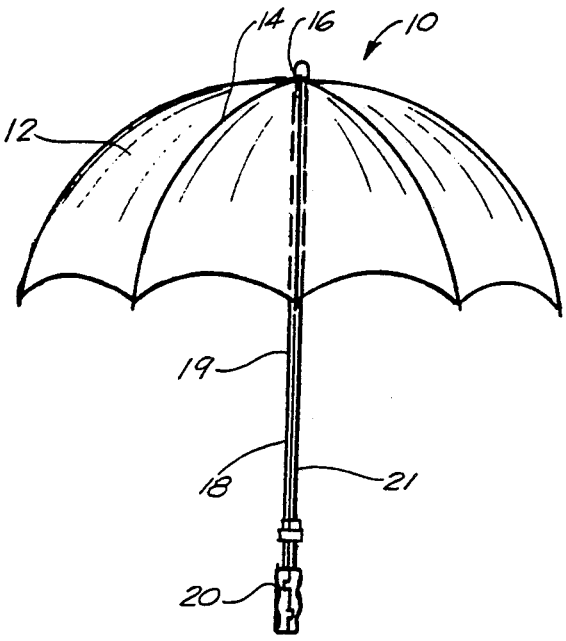
FIG. 1 illustrates an overall view of the preferred embodiment of the of the present invention.
Figure 2:
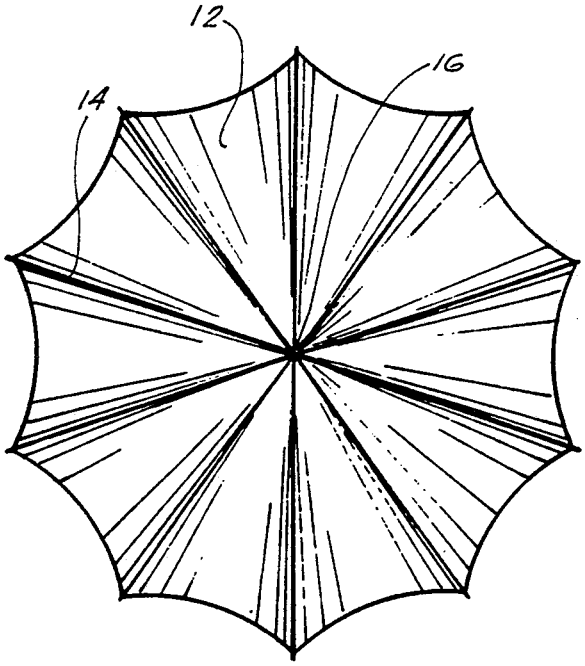
FIG. 2 illustrates a top view of the preferred embodiment of the apparatus of the present invention.

FIGS. 1 through 7 illustrate the preferred embodiment of the apparatus of the present invention by the numeral 10. As seen in FIG. 1, there is illustrated the standardized configuration of umbrella 10. Umbrella 10 includes an expanded umbrella portion 12, made of the flexible water impermeable material, which as been expanded to the opened position and held in position via a plurality of tynes 14, which emanate from a hub 16 at the very top portion of a stem member 18, which ends in a lower handle portion 20, through which a single individual may hold the handle portion 20 during use. Basically, this is a standard configuration of any umbrella which would move from the open position as seen in FIG. 1 to a closed position. FIG. 2 illustrates also umbrella 10 with top portion 12 expanded outward via a plurality of tynes 14 in the standard circular configuration emanating from hubs 16, as illustrated.

Figure 3:
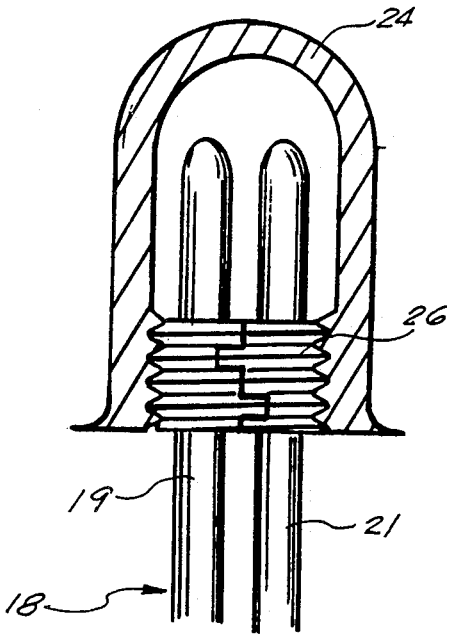
FIG. 3 illustrates an isolated view of the stem of the umbrella.

In this particular invention, for purposes of use, stem 18, as illustrated and seen more closely in FIGS. 2 through 7, comprises in reality a pair of stems 19 and 21, which in the standardized configuration are positioned side-by-side to form a single stem 18. At the very top at hub 16, as seen in FIG. 3, there is a cap member 24 which threadably engages around a threaded stem 26, so that the pair of stems 19 and 21 are held in position side-by-side so as to form the single stem 18. Likewise, at the lowermost end, there is illustrated handle 20 (see FIG. 6), wherein there is one-half of a handle 23 and the second half of a handle 25, which a pair of interlocking extrusions 27 interlock to form the single composite handle 20. There is provided a flexible velcro strap 30, around the upper portion of stem 12, so that as when handle members 23 and 25 are locked, velcro strip 30 can be wrapped around handle 18 to form the composite handle 18.

Figure 4:
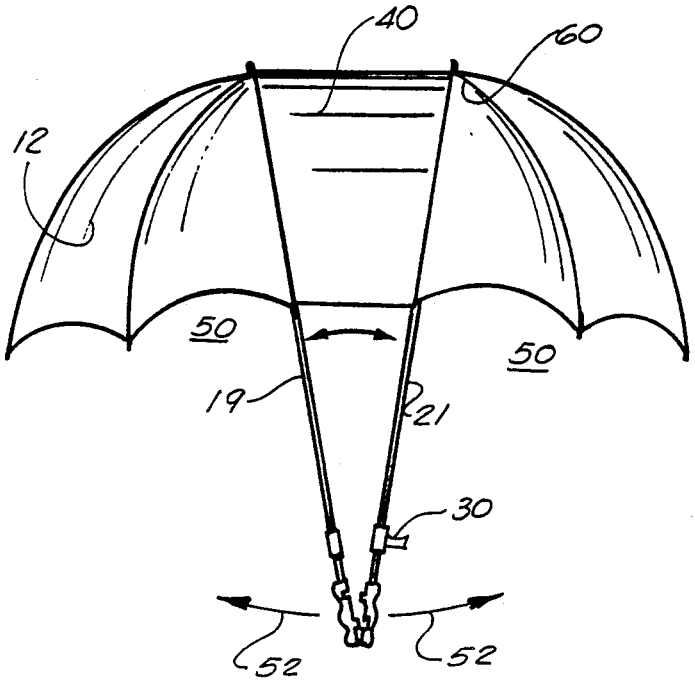
FIGS. 4 and 5 illustrate side and top views respectfully of the umbrella in the expanded mode.
Figure 5:
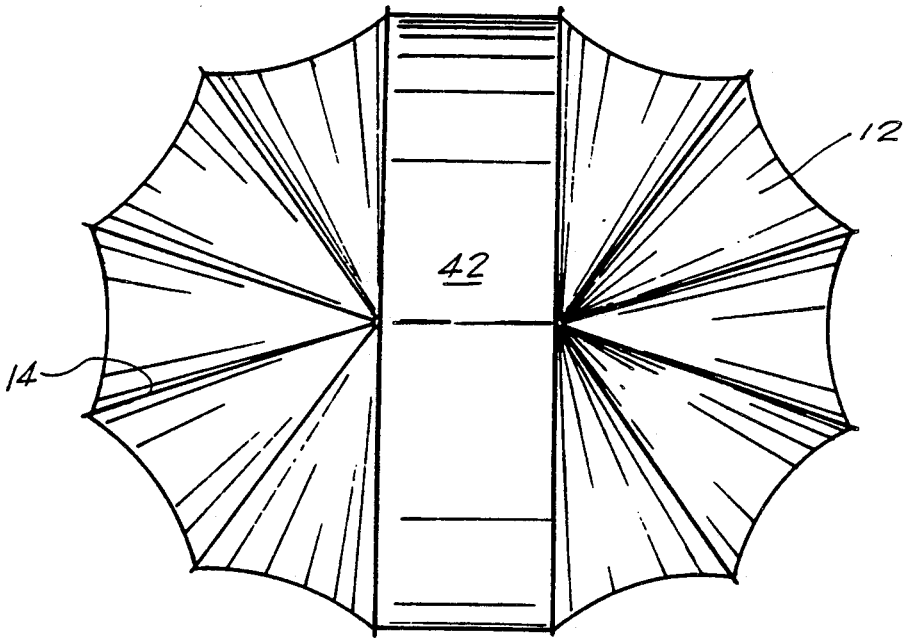
Figure 7:
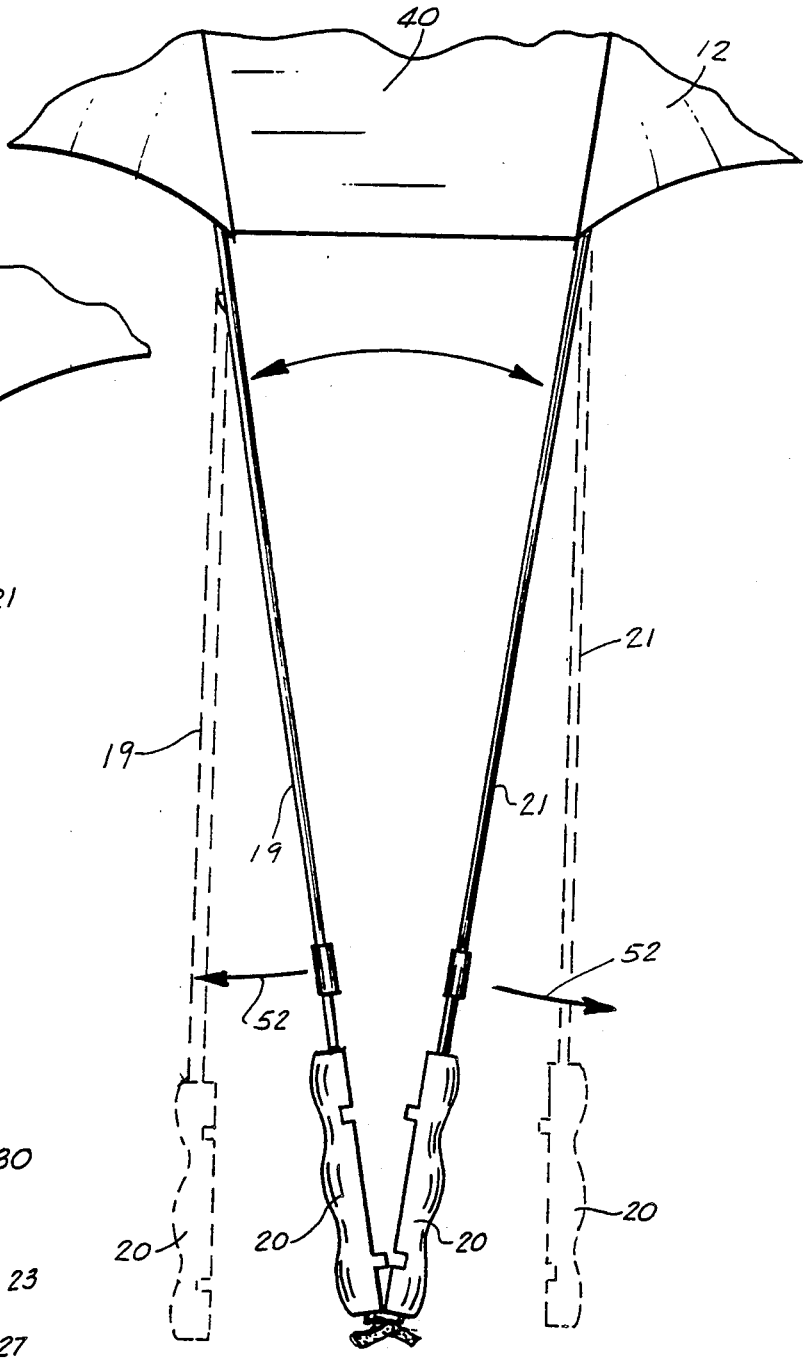

Turning now to the manner in which the umbrella operates in the expanded configuration, reference is made to FIGS. 4, 5, and 7. As illustrated, in FIG. 4, upon the removal of cap 24 from the upper end portion 16 of the umbrella, the umbrella cover 12, has an expandable central flap portion 40 which is an impermeable material spreading along the central axis of the umbrella, and forming an expansion zone 42 as illustrated in top view in FIG. 5. This expanded zone 42 enables the coverage of the umbrella to go from the standardized coverage of a certain width as seen in FIG. 1, to an expanded coverage area 50 as seen in FIG. 4. This expanded coverage area such that it could accommodate more than a single individual utilizing the umbrella. As seen in FIG. 4, the lower handle portion 20 is still maintained together, in view of the fact that the single individual may still wish to hold handle 20 although more than one individual is under the umbrella. If the users wish, the velcro strap 30 may be released from the stems 19 and 21 and the handle 20 may be separated in the direction of arrows 52, and therefore each of the individuals under the umbrella may hold one portion of the handle 20. In the configuration in FIG. 4, as seen in top view, and in FIG. 5, again one will note the expanded area into a more oval type of a protection area under the fabric 12 than is seen in FIG. 2 in top view and therefore having the ability to protect more than one individual.

Figure 6:
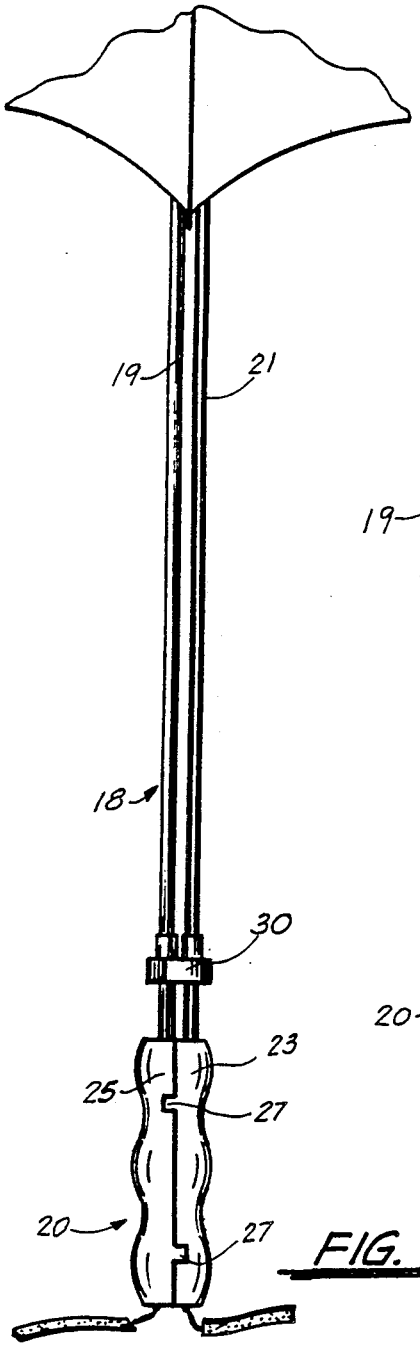
FIGS. 6 and 7 illustrate the lower portion of the stem of the umbrella both in the standard and the expanded modes.

In FIG. 7 there is illustrated in detailed view the manner in which the stems 19 and 21 (in phantom view)

have been separated to form the composite expanded umbrella coverage 12, with central flap portion expanded outward. Again, in this configuration as seen in FIG. 7, handle 20 may be separated out in the direction of arrows 52 and each of the handle portions held by a single individual. For purposes of storage, when the umbrella is returned to the normal standard coverage area as seen in FIGS. 1, 2, and 6, the flap portion 40 would simply be pushed downward under the umbrella, and may be rolled tightly up against the top curve 60 of the inner surface of the umbrella of top 12, so as to be maintained out of the way while the umbrella is in the closed position as seen in top view in FIG. 2.

For purposes of construction, it is foreseen that this construction would be of a light-weight material, that could easily be manufactured to standards as disclosed in this application, and therefore enable the user to utilize the umbrella freely either as a single individual or as more than one individual who wants multiple coverage by the expanded version of the umbrella.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A foldable umbrella apparatus, comprising:

(a) an umbrella top portion, for forming a cover when the top portion is moved to an expanded configuration;

(b) a stem member extending downward from the top portion for defining a means for holding the umbrella upright;

(c) means for separating the stem member into first and second stem portions, each of said first and second stem portions to be held by one individual in substantial parallel relationship; and (d) fabric means associated with the top portion for expanding outward when the stem portions are each held by an individual, so as to extend the width of the umbrella cover.

(e) means for holding the umbrella upright further comprises a portion which moves from a first locked position forming a single handle portion when held by one individual, to a second unlocked position defining two handle portions each to be held by an individual.

2. The apparatus in claim 1, wherein the fabric means for expanding the top portion further comprises a width of material across and along a centerline of the top portion which allows the top portion to expand outward a distance the width of the fabric.

3. The apparatus in claim 1, wherein the stem member further comprises means for locking the upper end of the stem portion and the lower end of the stem portion into a single stem.

4. The apparatus in claim 3, wherein upon removal of the locking means from the stem member, the stem member is expandable to a pair of stem portions, each portion to be held by an individual.

5. An expandable umbrella apparatus comprising:

(a) a top cover portion which is movable from a first folded down position to a second expanded up position for protecting a user;

(b) a stem member extending downward from the top portion for holding the umbrella upright when the top portion is in the expanded position, the stem member further comprising a pair of first and second stem portions when held upright together to form the stem member;

(c) a cap member on the top portion of the stem member for holding the stem portion in the single stem configuration;

(d) a velcro member on the lower portion of the stem member for maintaining the lower portion of the stem in the single configuration; and (e) an expanse of fabric, folded inward in a first position when the cap portion and the velcro member are in place, to a second expanded position, when the cap portion and the velcro member are removed, and the stem member is separated into first and second stem portions, each of which may be held apart in substantial parallel relationship by two or more individuals.

* * * * *